United States Patent [19]

Stejskal et al.

[11] Patent Number: 4,527,384

[45] Date of Patent: Jul. 9, 1985

[54] METHOD OF AND APPARATUS FOR PRODUCING MULTICOMPONENT SPUN-TWISTED YARNS BY OPEN-END SPINNING

[75] Inventors: Alois Stejskal; Zdenek Havranek, both of Usti nad Orlici; Miroslac Stepanek, Sopotnice; Jan Hrdina, Usti nad Orlici; Frantisek Cada, Usti nad Orlici; Zelmira Borovcova, Usti nad Orlici; Jaroslav Slingr, Usti nad Orlici, all of Czechoslovakia

[73] Assignee: Vyzkumny ustav bavinarsky, Usti nad Orlici, Czechoslovakia

[21] Appl. No.: 545,087

[22] Filed: Oct. 25, 1983

[51] Int. Cl.[3] ..... D01H 7/882; D01H 1/12; D02G 3/38

[52] U.S. Cl. ..... 57/404; 57/5; 57/411; 57/415; 57/409

[58] Field of Search ..... 57/5, 6, 400, 404, 409, 57/411, 415, 417

[56] References Cited

U.S. PATENT DOCUMENTS

| | | | |
|---|---|---|---|
| 3,445,993 | 5/1969 | Vorisek | 57/5 X |
| 3,605,395 | 9/1971 | Morikawa et al. | 57/5 X |
| 4,083,173 | 4/1978 | Artzt et al. | 57/404 X |
| 4,302,925 | 12/1981 | Edagawa et al. | 57/5 X |
| 4,302,926 | 12/1981 | Maixner et al. | 57/5 X |
| 4,364,223 | 12/1982 | Vignon | 57/411 X |

*Primary Examiner*—John Petrakes

[57] ABSTRACT

A single-step stable method of producing spun-twisted yarns. A twist point is located on the frictional surface of a take-off funnel of the spinning rotor. A strand material which forms a component of the final spun-twisted yarn product is exposed, between feed rollers and said twist point, to an appropriate combination of transport effects of a pneumatic field of force and a mechanical field of force. For this purpose, the tube, through which the strand material is supplied, is determined in dependence on the pneumatic conditions prevailing in the spinning rotor.

3 Claims, 3 Drawing Figures

METHOD OF AND APPARATUS FOR PRODUCING MULTICOMPONENT SPUN-TWISTED YARNS BY OPEN-END SPINNING

This invention relates to a method of and apparatus for producing multicomponent spun-twist yarns in the spinning rotor of open-end spinning machines in which the rotor is exposed to a sub-atmospheric pressure. One of the components of the spun-twist yarn is a staple yarn being spun in the spinning rotor, while the other component thereof is a strand material which is supplied by a pair of feed rollers to the spinning rotor of the spinning machine. The strand material is fed to the rotor through a feeding tube passing through the hollow spindle of the spinning rotor, at a speed exceeding the take-off speed of the final spun-twist yarn product, which is withdrawn from the spinning rotor to a stationary take-off funnel having a frictional surface.

Essentially, there are substantially known two groups of processes and apparatuses for producing multicomponent yarns in the spinning rotor of an open-end spinning machine. In the first group, a strand material is fed, in more or less tensioned condition, in an axial direction, to the spinning rotor and is withdrawn from it through a coaxial take-off duct. The wrapping up of the strand material by the staple yarn in the take-off duct does not take place unless the strand material is exposed to an extremely high axial tension. The strand material coming in contact with a staple yarn is exposed to too high a force load with respect to the tension of the staple yarn being spun and, apart from this, this load is variable, due to varying passive resistances. In this way there is produced a yarn the structure of which varies between the character of twisted yarn and core yarn. Such yarn is therefore unsuitable for being used in practice. Moreover, the process of wrapping the staple yarn component about the strand material is impaired, due to the fact that the strand material component is more rigid than the staple yarn.

As to the second group of known processes and apparatuses, the strand material is supplied to the collecting group of the spinning rotor where it joins the fibrous ribbon and where it is twisted together with it and finally withdrawn through the take-off duct. In this way, core yarn structures are created. A disadvantageous feature of this process is that in this process a false twist is imparted to the strand material; this leads after a time to the interruption of the spinning operation so that the process is considerably unstable and unusable in industrial practice.

Further, there are known processes of manufacturing multicomponent twisted yarns in the spinning rotor wherein a strand material supplied through a duct in the spinning rotor cover, is twisted together with a staple yarn at a point situated, in one case, outside the periphery of the yarn take-off funnel in the direction of the collecting groove, and, in another case, on the inner periphery of the take-off funnel opening.

The disadvantage of both the above two alternatives consists in that the force actions cannot be sufficiently controlled in said contact point which is, in the first case, free in the spinning rotor space, and, in the second case, outside the active surface of the yarn take-off funnel, whereby the structure and consequently the characteristics of the multicomponent yarn produced are negatively influenced.

A common insufficiency of the two processes and apparatuses for performing the same lies in that the yarn take-off funnel is installed in the hollow spindle of the spinning rotor, which arrangement brings about some technological difficulties, due to a reduced possibility of employing funnels of various forms and sizes.

It is an object of the present invention to eliminate the disadvantages of the prior art as hereinabove set forth, and to provide a method of producing multicomponent yarns of spun-twisted yarn character, wherein the strand material component constituted by a filament yarn, a monofilament or a spun yarn, is wound at a twist point above the staple yarn, and to ensure the uniformity and stability of such new process and consequently the desired yarn quality.

In accordance with the invention, the supplied strand material on its way to the spinning rotor is exposed to two active fields of force, viz. a first pneumatic field of force produced in the feeding tube by an air flow speed, and a second mechanical field of force produced by a combination of an axial force in the staple yarn being built, together with a centrifugal force of a rotating length section of the stand material, and of the resultant of frictional forces produced on the frictional surface of the take-off funnel. The resulting transport effect of the pneumatic field of force is higher than the resulting transport effect of the mechanical field of force, said higher effect causing a relative rotary motion of the strand material introduced into the spinning rotor, about the axis of the staple yarn which is thus wrapped up by said strand material at a twist point on the frictional surface of said take-off funnel.

By a higher effect of the pneumatic field of force produced by a predetermined sub-atmospheric pressure in the space within the spinning rotor with respect to the resulting transport effect of the mechanical field of force on the yarn, there is achieved the result that in this space the rotating length of the staple yarn causes a respective length of strand material to make a relative rotary motion about the staple yarn axis so that owing to the combination of these two revolving motions, the strand material is wound about the staple yarn, without the former being given a temporary twist. In this way, the desired conditions are established for stabilizing the process of spin-twisting and for manufacturing first-grade spun-twisted yarns.

For carrying out the method of the invention an apparatus is provided comprising a pair of feed rollers for supplying the strand material into the spinning rotor through a feeding tube passing through the hollow spindle of the spinning rotor and the opening in the spinning space of said rotor, and a pair of take-off rollers for withdrawing the final spun-twist yarn over a stationary take-off funnel axially arranged in the rotor. The improvement is that the cross-sectional area of the feeding tube is determined by the dependence upon the total air volume through flow at the air outlet of the spinning rotor of the basis of the equation:

$$S = \frac{V}{0.9 \text{ to } 2.5}$$

in which

S is the cross-sectional area of the feeding tube in square millimeters, and

V is the total air volume throughflow in liters per second.

In accordance with the invention, the length of the feeding tube varies from 70 to 100 times its inner diameter.

The advantage of the method and apparatus according to the present invention consists in the provision of a very stable process of wrapping a strand material about the staple yarn component even a high yarn production rates of the open-end rotor spinning unit, and also ensuring this stability in case of varying ratios between the velocities of supplying the strand material and withdrawing the multicomponent yarn therein. The thus produced yarn exhibits the structure of a conventionally twisted yarn and possesses physical-mechanical characteristics that makes it suitable for industrial applications.

The invention will be more readily understood with reference to accompanying schematic drawings showing a preferred embodiment thereof. In the drawings.

Figure 1:
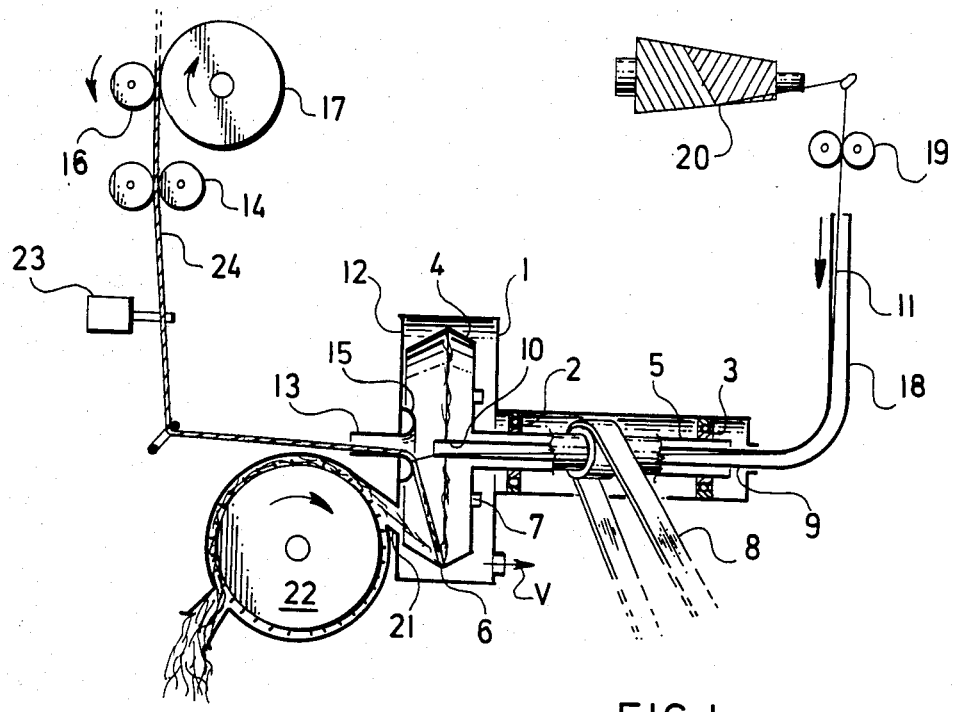
FIG. 1 is a view in axial section of a spinning unit of the open-end spinning machine employed in performing the method of the present invention.

Turning now to FIG. 1, an open-end spinning unit employed in the practice of the invention comprises a spinning housing 1 in which the hollow spindle 5 of a spinning rotor 4 is mounted for rotation in bearings 2 and 3. Around its maximum inner periphery, the spinning rotor 4 is provided in its interior with a collecting groove 6 into which individual fibers supplied to said rotor 4 are deposited. The spinning rotor 4 is further provided with ventilation holes 7 for producing a sub-atmospheric pressure in the interior of the rotor, such pressure being necessary for supplying fibers and for introducing the yarn end back into the rotor 4 for being spun-in. However, such ventilation holes 7 may be omitted in those cases in which the production of sub-atmospheric pressures is provided for by connecting the rotor interior with an outside sub-atmospheric pressure source.

The spinning rotor 4 is driven from a driving means (not shown) though an endless driving belt 8. The hollow spindle 5 accommodates a stationary feeding tube for supplying a strand material 11.

Figure 2:
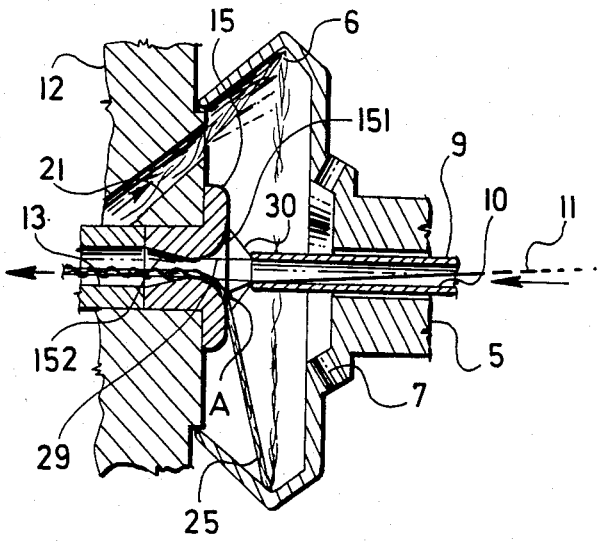
FIG. 2 is a fragmentary axial sectional view showing the spinning rotor of the open-end spinning unit of FIG. 1 more in detail.

In a lid 12 covering the open side of the spinning rotor 4 there is provided a yarn take-off duct 13, the outlet of which is followed by a pair of take-off rollers 14. The inlet of said take-off duct 13 in the interior of the spinning rotor 4 is formed as a yarn take-off funnel 15 provided with a frictional surface 151 (FIG. 2) in the form of a suitable rounding-off, coating, or knurling. The take-off funnel 15 has a cavity 152 for withdrawing the final yarn product. The pair of take-off rollers 14 is followed by a winding roll 16 for winding the produced spun-twisted yarn 24 onto a bobbin 17.

The feeding tube 10 may consist either of an inner portion 9 and an outer portion 18, or it may be formed as an integral element. It is preferably embodied as a tube, but also other suitable shapes thereof can be used. The inlet of said outer portion 18 is preceded by a pair of feed rollers 19 for supplying the strand material 11 withdrawn from a supply package 20 thereof.

As can be seen in FIG. 1 fibers are supplied from a sliver opening device 22 to the collecting groove 6 of the spinning rotor 4 through a fiber supply duct 21. Between the outlet of the take-off duct 13 and the take-off rollers 14 there is disposed a conventional thread breakage feeler 23. In case of a thread breakage, the feeler 23 stops the fiber supply to the sliver opening device 22.

Figure 3:
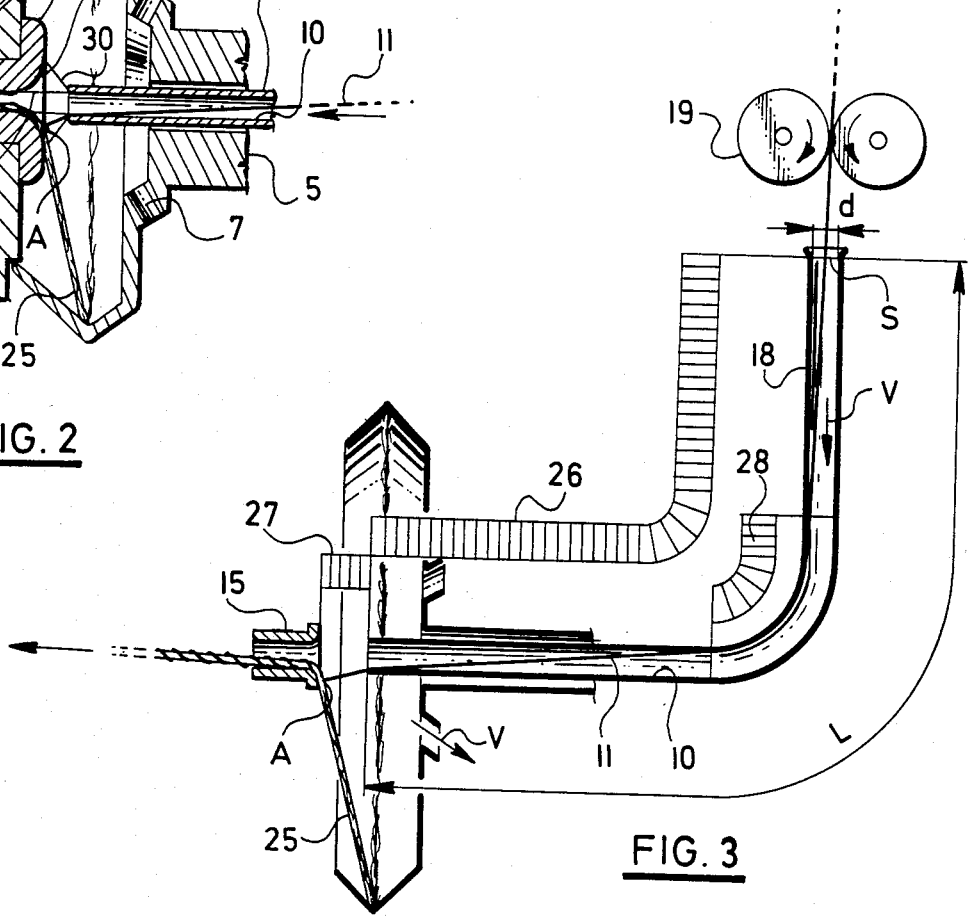
FIG. 3 is a fragmentary sectional schematic view showing the duct through which the strand material is supplied.

FIG. 3 shows the communication of the feeding tube 10 with the spinning space of the spinning roller 4 where a sub-atmospheric pressure prevails. To assume its strand material transporting function, the tube 10 has predetermined dimensions, with an inner diameter d, a cross-sectional area S, and a total length L. The pneumatic effect of the spinning rotor interior is characterized by total air volume throughflow W at the air outlet of the spinning rotor 4.

The above-described apparatus operates as follows:

A supplied sliver of stapled fibers is opened in the sliver opening device 22, and separated fibers are fed through the supply duct 21 into the collecting channel 6 of the spinning rotor 4 where they are deposited to form a fibrous ribbon. Due to the rotation of the spinning rotor 4 and the effect of the frictional surface 151 of the take-off tube funnel 15, the fibrous ribbon is given a torque by the re-introduced yarn end. By the action of said torque the ribbon is rolled into a yarn configuration and withdrawn in this form through the cavity 152 of the take-off funnel 15 and further on through the take-off duct 13 by means of the take-off rollers 14.

The second yarn component, i.e. the strand material 11, i.e. a filament yarn, a monofilament, or a previously spun yarn, is withdrawn from the supply package 20 and supplied by the feed roller 19 to the feeding tube 10. To achieve the desired structure of a spun-twisted yarn, the stand material 11 is supplied in over feed, which means that the feed rollers 19 are caused to rotate at a higher peripheral speed than the take-off rollers 14. The aforementioned quicker transport of the strand material 11 through the feeding tube 10, with respect to the take-off speed of the spun-twisted yarn, is caused by exposing the yarn to a continuous pneumatic active field of force 26 (FIG. 3) produced by the air flow velocity in the feeding tube 10. To obtain the desired effect of said pneumatic field of force 26 with usually employed types of strand material, the corresponding air flow parameters have to be established by appropriately dimensioning the feeding tube 10. Through such a dimensioned feeding tube 10 the strand material 11 is transported in the inner space of the spinning rotor 4 where, at a twist point A, it i wrapped around the staple yarn 25, due to the rotation of the latter on the frictional surface 151 of the take-off funnel 15.

The aforementioned section of the strand material 11 is exposed to the action of a second mechanical field force 27 which is substantially produced by an axial force acting upon the rotating length section of the strand material 11, and by the resultant of forces arising by friction of yarn and the take-off funnel 15. Apart from the above-mentioned fields of force, the strand material 11 is exposed to the effect of a third, passive field 28 which acts in counter-direction of its advance through the feeding tube 10, and which is essentially produced by the friction of the material at the walls and bent portions of said tube as well as by electrostatic forces and the rigidity of the strand material 11 itself.

To optimalize the kinematic process of building a spun-twisted yarn, wherein the staple yarn is wrapped up by the strand material, it is necessary to situate the geometric position of the twist point A in the space outside the axis of the spinning rotor 4, said space being defined by (1) the inlet opening 29 of the take-off funnel cavity and the mouth of the feeding tube 10, (2) an imaginary lateral area of a cone between the outer edge of the frictional surface 151 of the take-off funnel 15 and the outlet of the feeding tube 10, and (3) by said frictional surface 151. This preferable geometrical position of the twist point A is obtained by establishing adequate conditions of the twist process dynamics so that the resulting effect of the pneumatic field of force 26 which influences the transport of strand material 11, may be higher tan that of the mechanical field of force 27. For the protecting of soft twisted yarn according to the invention, it is further preferred to make the difference between the above two effects equal to, or higher than, the value of the passive field 28.

The method and apparatus of the invention make it possible to produce spun-twisted yarns in a single step in an open end rotor spinning machine having a plurality of spinning units and obtain a suitable structure of yarns to be processed to final products with new useful properties. A part from this, the method of manufacturing spun-twisted yarns in accordance with the invention is stable and industrially applicable.

Although the invention is described and illustrated with reference to a single embodiment thereof, it is to be expressly understood that it is in no way limited to the disclosure of such preferred embodiment but is capable of numerous modifications within the scope of the appended claims.

We claim:

1. In a method of producing multicomponent spun-twisted yarns in the spinning rotor exposed to a sub-atmospheric pressure of an open-end spinning unit, wherein one of the components is a staple yarn being spun in the spinning rotor while the other component is a strand material which is supplied by a pair of feed rollers to the spinning rotor through a feeding tube passing through the hollow spindle of the spinning rotor at a speed exceeding the take-off speed of the spun-twisted yarn which is withdrawn from the spinning rotor through a stationary take-off funnel having a frictional surface, the improvement wherein the supplied strand material on its way to the spinning rotor is exposed to two active fields of force, viz. a first pneumatic field of force produced in the feeding tube by an air flow speed, and a second mechanical field of force produced by a combination of an axial force in the staple yarn being built, together with a centrifugal force of a rotating portion of the strand material, and of the resultant of frictional forces produced on the frictional surface of the take-off funnel, the resulting transport effect of the pneumatic field of force being higher than the resulting transport effect of the mechanical field of force, said higher effect causing a relative rotary motion of the strand material, introduced into the spinning rotor, about the axis of the staple yarn which is thus wrapped up by said strand material in a twist point on the frictional surface of said take-off funnel.

2. In an apparatus for carrying out the method of producing a multicomponent spun-twisted yarn, said apparatus comprising of an open-end spinning rotor exposed to a sub-atmospheric pressure of an open-end spinning unit, said rotor having a hollow spindle and a spinning space within said rotor, a feeding tube passing through the hollow spindle of the spinning rotor into the spinning space of said rotor, a pair of feed rollers for supplying strand material into the spinning rotor through said feeding tube, an axially arranged stationary take-off funnel disposed within the spinning space in the rotor, a pair of take off rollers for withdrawing the spun-twisted yarn through the take-off funnel, and an air outlet for the spinning rotor, the improvement wherein the cross-sectional area of the feeding tube is determined by the dependence upon the total air volume through flow at the air outlet of the spinning rotor on the basis of the equation $$S = \frac{V}{0.9 \text{ to } 2.5}$$

in which

S is the cross-sectional area of the feeding tube in square millimeters, and

V is the total air volume throughflow in liters per second.

3. An apparatus as claimed in claim 2, wherein the length of the feeding tube varies from 70 to 200 times its inner diameter.

* * * * *